US008146508B2

(12) United States Patent
Flynn

(10) Patent No.: US 8,146,508 B2
(45) Date of Patent: Apr. 3, 2012

(54) PNEUMATIC MASS TRANSPORTATION SYSTEM

(76) Inventor: Patrick Joseph Flynn, Pinckney, MI (US)

( * ) Notice: Subject to any disclaimer, the term of this patent is extended or adjusted under 35 U.S.C. 154(b) by 96 days.

(21) Appl. No.: 12/587,066

(22) Filed: Oct. 1, 2009

(65) Prior Publication Data

US 2010/0083864 A1 Apr. 8, 2010

Related U.S. Application Data

(60) Provisional application No. 61/195,509, filed on Oct. 8, 2008.

(51) Int. Cl.
*B61B 13/10* (2006.01)

(52) U.S. Cl. ..... 104/138.1; 104/156; 104/155

(58) Field of Classification Search ..... 104/138.1, 104/156, 159, 27, 28, 23.2, 130.07; 414/236, 414/237, 331.04

See application file for complete search history.

(56) References Cited

U.S. PATENT DOCUMENTS 1,061,035 A * 5/1913 Batcheller ..... 104/119
3,403,634 A * 10/1968 Crowder ..... 104/138.1
3,404,638 A * 10/1968 Edwards ..... 104/156
3,601,158 A * 8/1971 Edwards ..... 138/106
3,734,428 A * 5/1973 Alexandrov et al. ..... 406/185
3,749,026 A * 7/1973 Carrasse ..... 104/156
3,776,141 A * 12/1973 Gelhard et al. ..... 104/123
3,797,405 A * 3/1974 Carstens et al. ..... 406/105
3,954,064 A * 5/1976 Minovitch ..... 104/138.1
3,985,081 A * 10/1976 Sullivan, II ..... 104/23.2
3,999,487 A * 12/1976 Valverde ..... 104/138.1
4,017,039 A * 4/1977 Carstens ..... 406/105
4,018,410 A * 4/1977 Renaux ..... 705/7.12
4,023,500 A * 5/1977 Diggs ..... 104/138.1
4,036,146 A * 7/1977 Tyus ..... 104/307
4,072,109 A * 2/1978 Kovanov et al. ..... 104/138.1
4,075,947 A * 2/1978 Soschenko et al. ..... 104/23.2
4,108,077 A * 8/1978 Laing ..... 104/156
4,113,202 A * 9/1978 Ueno ..... 406/185
4,166,419 A * 9/1979 Ardeleanu ..... 104/138.1
4,182,243 A * 1/1980 Ceauselu ..... 104/138.1
4,458,602 A * 7/1984 Vandersteel ..... 104/138.1
4,630,961 A * 12/1986 Hellwig ..... 404/1
4,703,697 A * 11/1987 Bell ..... 104/23.1
4,841,871 A * 6/1989 Leibowitz ..... 104/23.1
4,881,469 A * 11/1989 Hirtz ..... 104/138.1
4,899,665 A * 2/1990 La Sorte ..... 104/23.1
4,940,368 A * 7/1990 Marcu ..... 406/79
5,253,590 A * 10/1993 Marusak ..... 104/138.1
5,460,098 A * 10/1995 Jackson et al. ..... 104/23.2
5,537,929 A * 7/1996 Miura et al. ..... 104/156
5,720,363 A * 2/1998 Kipp ..... 186/55
5,909,710 A * 6/1999 Cummins ..... 104/23.2
6,178,892 B1 * 1/2001 Harding ..... 104/155
6,279,485 B1 * 8/2001 Schlienger ..... 104/156
6,318,274 B1 * 11/2001 Park ..... 104/88.02

(Continued)

*Primary Examiner* — S. Joseph Morano
*Assistant Examiner* — Jason C Smith
(74) *Attorney, Agent, or Firm* — Mark Young, P.A.

(57) ABSTRACT

A pneumatic mass transportation system employs a combined cycle turbine power system with digital controls to effect acceleration, deceleration and train propulsion. Combustion turbines can be adapted to use alternative fuels including bio fuels as they are developed. A heat recover steam generator recycles hot exhaust gasses from turbines to generate electricity to be used by the system. A multi-car train is propelled by differential air pressure forward and aft of the vehicle in a pneumatic tube. Air propulsion is achieved by large in-tube impellers driven by the turbines. A digital control system controls turbine speed, pitch of impeller blades and vacuum/pressure release valves in the tubes to maneuver and control the train.

6 Claims, 4 Drawing Sheets

U.S. PATENT DOCUMENTS

Figure 1:
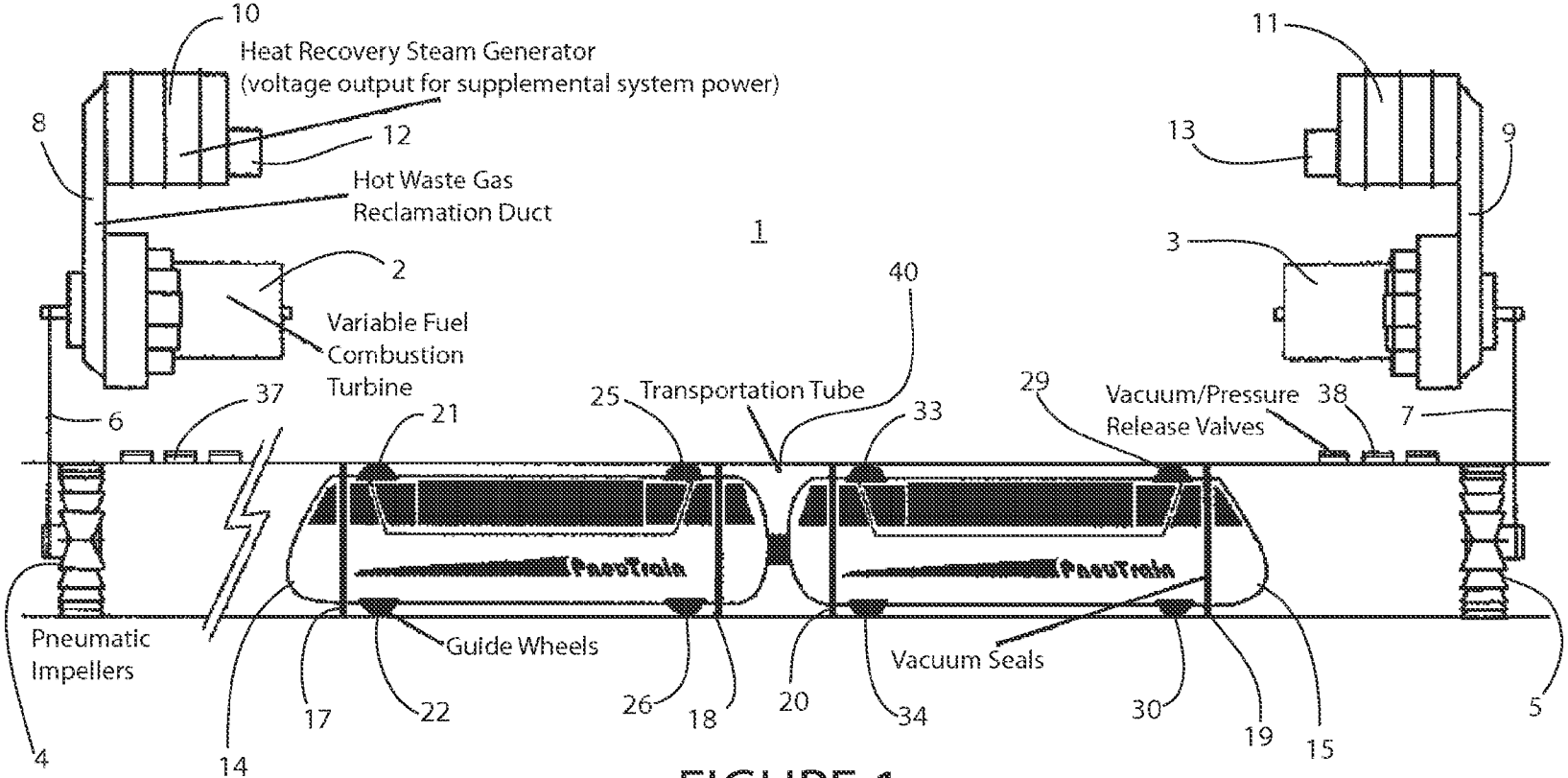

| | | | | |
|---|---|---|---|---|
| 6,418,856 | B2 * | 7/2002 | Hossfield et al. | 104/130.01 |
| 6,644,209 | B2 * | 11/2003 | Cummins | 104/156 |
| 6,810,817 | B1 * | 11/2004 | James | 104/88.04 |
| 6,877,439 | B2 * | 4/2005 | Chapman | 104/118 |
| 7,138,596 | B2 * | 11/2006 | Pippin et al. | 209/584 |
| 2003/0010872 | A1 * | 1/2003 | Lewin et al. | 246/122 R |
| 2003/0089267 | A1 * | 5/2003 | Ghorbel et al. | 104/138.1 |
| 2003/0101896 | A1 * | 6/2003 | Cummins | 104/156 |
| 2009/0101040 | A1 * | 4/2009 | Yang | 104/138.1 |
| 2010/0083864 | A1 * | 4/2010 | Flynn | 104/138.1 |

* cited by examiner

PNEUMATIC MASS TRANSPORTATION SYSTEM

REFERENCE TO RELATED APPLICATIONS

This invention claims priority to U.S. Provisional Patent Application No. 61/195,509 of the same title and filed Oct. 8, 2008, the entirety of which is hereby incorporated by reference.

FEDERALLY SPONSORED RESEARCH OR DEVELOPMENT

Not applicable.

REFERENCE TO SEQUENCE LISTING

Not applicable.

BACKGROUND

1. Field of Invention

The need is imperative to develop new forms of safe, alternative transportation that are supremely energy efficient. This invention represents a unique approach to pneumatic ground transportation for passengers and cargo. The system's power source, method of propulsion and controls are exclusive elements to this invention.

2. Description of Prior Art

Pneumatic passenger systems have been conceived to date. They are burdened with un-resolved issues inherent in pneumatic systems intended for use other than the transport of inanimate objects. Power sources and control of movement of prior art have been problematic and present serious hindrances to practical development. Other system concepts are plagued with friction-related drawbacks due to car travel on slides and tracks within the tube. Pneumatic transportation of live passengers was developed into a prototype stage by Alfred Ely Beach in New York City in 1870. The use of a primitive power source (steam engine), the wooden tube, leather seals and lack of any practical movement control plagued the invention. The simultaneous development of the electric subway train then eclipsed all feasibility of Beach's efforts. The PneuTrain system detailed herein addresses and satisfies all drawbacks of prior art and incorporates new computer-based technology to solve the most critical of issues—the starting, stopping, acceleration and deceleration of the system in cooperation of its very robust power source.

SUMMARY OF THE INVENTION

The PneuTrain is a unique supremely efficient rapid pneumatic mass transportation system. This system incorporates a free moving train of passenger cars through a tube infrastructure powered by a combination of differential air pressure forward and aft of the train. The train cars will be cylindrical. They will contact the tube surface via guide wheels. Air power for the system will be provided by stationary combustion turbines and heat recovery steam generators at both ends of the pneumatic tube run. Combustion turbines can be adapted to utilize alternative fuels including bio-fuels and fuel cell technology as they are explored and implemented. The integration of heat recovery steam generation recycles the hot turbine exhaust to generate the electrical power needed for the system's controls. Air propulsion is generated through the use of large impellers in the tubes driven by the turbines. Speed control, acceleration and deceleration are all digitally controlled by the conductor. The digital controls will vary the speed of the turbine engines, vary the pitch of the impeller blades and control the operation of the pressure release valves imbedded into the tube walls in direct relation to the throttle position and operation by the conductor.

BRIEF DESCRIPTIONS OF THE ILLUSTRATIONS

FIG. 1: System configuration overview depicting vehicle, tube infrastructure, and power source.

Figure 2:
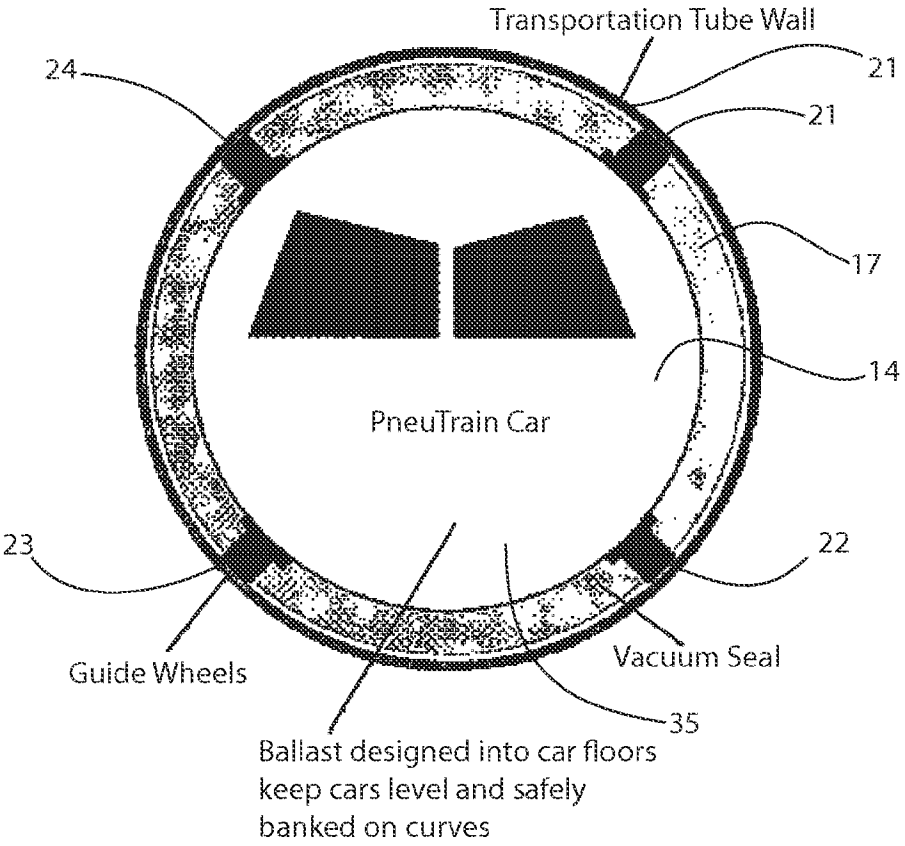

FIG. 2: Transportation tube cutaway view depicting front of vehicle, vacuum seal, guide wheels and ballast.

Figure 3:
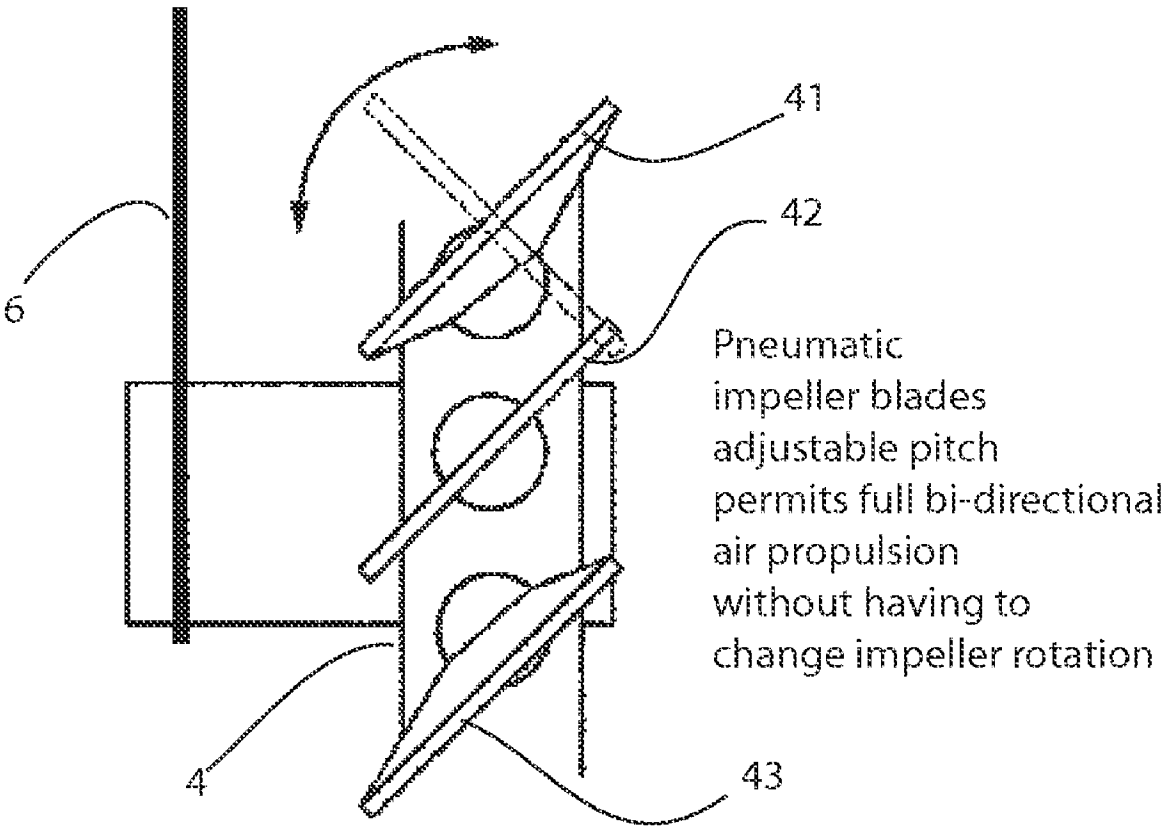

FIG. 3: Exploded view of exclusive impeller blade pitch control

Figure 4:
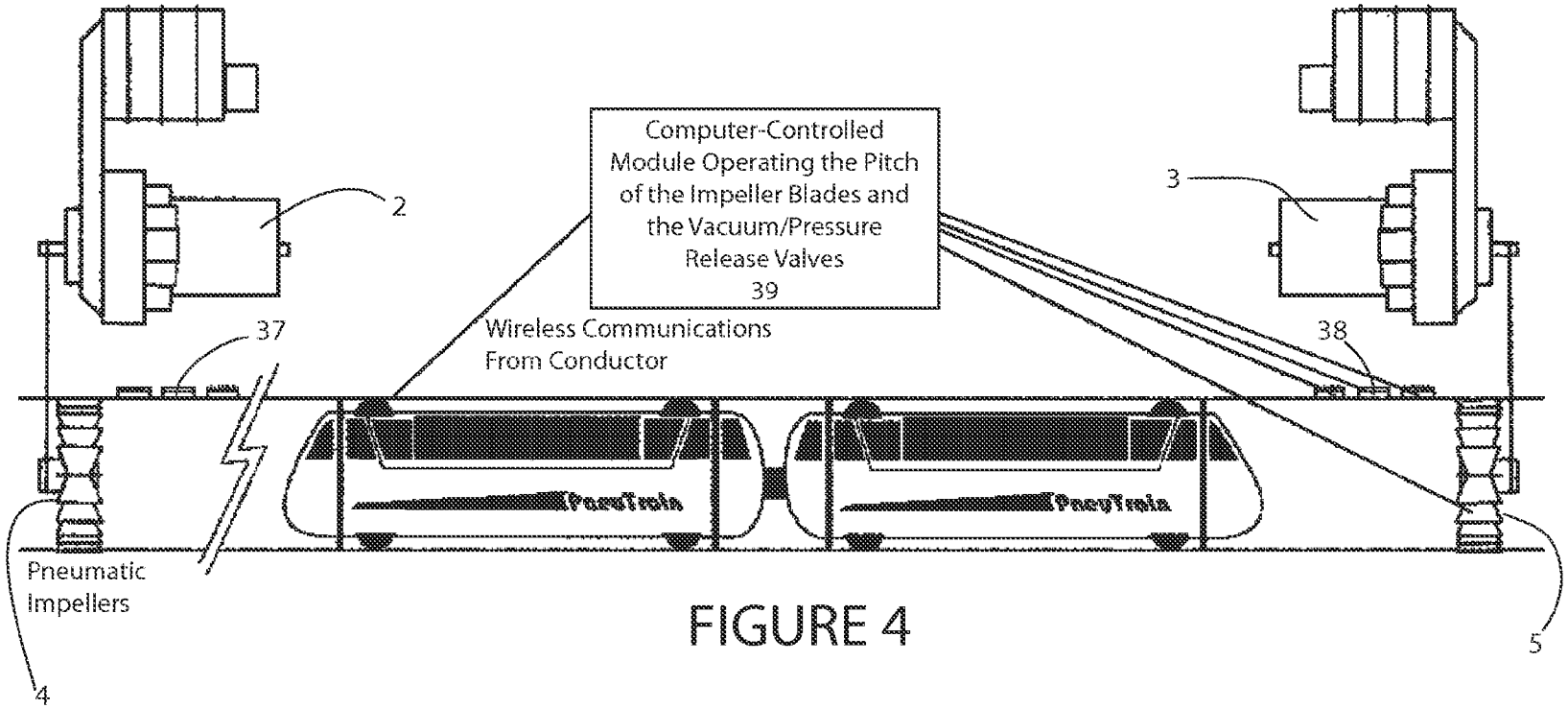

FIG. 4: System configuration depicting exclusive digital control operational features of vehicle movement.

DETAILED DESCRIPTION OF THE INVENTION

With reference to FIG. 1, the PneuTrain system 1 in concept utilizes as its power source the proven and energy efficient combination of combustion turbine technology married to a heat/exhaust recycling steam generator. This is exclusive to the PneuTrain 1. The main turbines 2, 3 will drive the impellers 4, 5 via a drive chain 6, 7. The turbines' 2, 3 hot exhaust gasses will enter a boiler 10, 11 via a duct 8, 9 to produce steam which in turn will power a steam turbine generator (heat recovery steam generation) 12, 13. This auxiliary power from reclaimed heat will be stored for use with the PneuTrain's 1 electrical system.

Clean natural gas is currently the fuel of choice to power the drive turbines. Natural gas is a very efficient fuel. It is also abundant in supply right here in the United States. Additionally, with reference to FIG. 1, the combustion turbine is a versatile power source to physically drive the pneumatic impellers 3, 4 of the PneuTrain system. The technology is well underway driven by global need to convert combustion turbines to utilize alternative fuel sources including bio fuels as they are developed, "Biofuels in Gas Turbines," *International Turbomachinery*, Vol. 49, No. 7, December, 2008. Since the fuel source is employed at the turbine 1, 2 rather than in the vehicle 1, the PneuTrain power system can be upgraded to use new fuels without having to upgrade, redesign or replace the PneuTrain cars or the transportation tube infrastructure.

The upper portion of the transportation tubes 3 can be designed to be transparent for visual access in portions of the pneumatic tube 3 that are exposed above ground and through buildings.

The PneuTrain cars are designed in the fashion of modem commuting subway cars providing seating on the sides and sufficient standing and maneuvering floor space.

Mechanical Detail

The PneuTrain cars 14, 15 in concept are cylindrical with vacuum seals 17, 18, 19 and 20 around their circumference. Guide wheels 21-34 with suspension keep the cars 14, 15 in place and provide smooth, consistent movement with minimum friction, as shown in FIGS. 1 and 2. With reference to FIG. 2, ballast 35 designed into car floors will keep the cars level in straight travel and safely banked on curves in proportion to the train speed. The PneuTrain car 14, 15 acting in the fashion of a free piston is propelled through the tube 40 utilizing differential air pressure forward and aft of the car. The air propulsion is generated from the pneumatic impellers 4, 5, which are driven by the turbines 2, 3 utilizing a chain 6, 7 drive system.

With reference to FIG. 3, the pneumatic impellers 4, 5 exclusive to this invention will be designed to fully adjust the pitch of their blades 41, 42, 43 to be capable of effecting air propulsion in either direction on the fly without having to change impeller 4, 5 rotation or turbine 2, 3 speed. This makes the PneuTrain 1 completely bi-directional in its travel capabilities.

PneuTrain car 14, 15 travel speed, acceleration, deceleration, starting and stopping will be controlled by computer management of the system control components. The three system control components are:

1. The impeller 4, 5 blade 41-43 pitch.
2. Turbine 2, 3 speed.
3. Variable vacuum/pressure release valves 37, 38.

The software-based control module 39 with wireless input, exclusive to the PneuTrain 1 will operate the system control components either individually or in combination as needed in direct proportion and movement of the PneuTrain's throttle which will be manually operated by the conductor. Manual overrides will be designed into the system for independent operation of the system control components in the event of a control module malfunction.

The PneuTrain cars 14, 15 will be equipped with battery-powered lighting and conditioned ventilation. A supplemental electrical motor will be on board that can be used to move the train completely independent of the pneumatic system in the unlikely event of pneumatic failure. The electrical power needed to recharge the batteries will be generated by the PneuTrain system's heat recovery steam generator 12, 13. When PneuTrain cars 14, 15 are not in use, they will be connected to this recharging system to keep the batteries fully charged.

PneuTrain stations will employ the opening of sections in the tube to accommodate the loading and unloading of passengers.

Impact

The PneuTrain 1 is transformational by its very nature. This will be the first highly technical pneumatic transport passenger system. Unlike aircraft that need their turbine exhaust for thrust, the turbines that power the PneuTrain system are stationary. This allows for full access to the turbines and the reclamation of the turbine's very hot exhaust for the purpose of generating the electric power needed for the system's lighting, ventilation, conditioning, and backup drive. The high efficiency and new alternative fuel potential make the PneuTrain a truly efficient concept. The development of the PneuTrain has the potential to put the United States at the cutting edge of modem mass transportation development.

The wide-scale implementation of the PneuTrain system will result in substantial reduction in energy use. As new fuels are developed domestically and retrofitted onto the system's turbines, we can see dramatic reductions in the imports of foreign energy resources for mass transportation.

The development of this invention opens wide the door for future development of the concept for long-distance, extremely high-speed usage.

Effective mass transportation enhances the quality of life of metropolitan areas both economically, and environmentally.

Home values, business values, and the marketability of communities rise dramatically in areas with good, reliable mass transportation.

Metro areas that develop cutting edge innovations in mass transportation, energy and vehicular traffic reductions attain national and global recognition.

The value-added appeal of the PneuTrain will be sought after by urban venues, theme parks, military bases, sports complexes, convention centers, airports and shopping malls. The system can be adapted for travel alongside bridges, through buildings and as underwater crossings.

Safety Considerations

Unlike all other forms of energy consuming transportation, no fuel or high voltage is present on board the PneuTrain cars and in proximity of the passengers, eliminating the possibility of dangerous fuel or energy related accidents.

Collisions are impossible since the design of the PneuTrain would have only one multi-car train per pneumatic tube run.

As mentioned above, the PneuTrain Cars will have a supplemental electrical motor to be able to move the cars through the tubes in the unlikely event of a pneumatic failure. Also on board will be a supplemental oxygen supply in the event of an emergency. Additionally, the transportation tubes will be designed with quickly removable sections or panels at strategic locations between stations for evacuation purposes.

The PneuTrain system is meant to be completely self-powered. Unlike subway systems and surface electrical trains, operation of the PneuTrain would be unaffected by electrical outages as long as the fuel source remains intact at the turbines. This would provide safe efficient mass transportation at vital times during power failures.

I claim:

1. A pneumatic transportation system comprising a tubular pathway forming a travel path, said tubular pathway having a first end and an opposite second end; and a multi-car vehicle within said tubular pathway, said multi-car vehicle traveling in response to a pressure differential within the tubular pathway, said multi-car vehicle having a plurality of guide wheels; and a power system comprising:

a plurality of turbines, including a first turbine located adjacent to the first end of the tubular pathway, and a second turbine located adjacent to the second end of the tubular pathway; and a plurality of heat recovery steam generators, including a first heat recovery steam generator operably coupled to the first turbine, and a second heat recovery steam generator operably coupled to the second turbine; and a plurality of pneumatic impellers, including a first pneumatic impeller mechanically driven by the first turbine, said first pneumatic impeller being located at the first end of the tubular pathway, and a second pneumatic impeller mechanically driven by the second turbine, said second pneumatic impeller being located at the second end of the tubular pathway.

2. A pneumatic transportation system according to claim 1, further comprising a vacuum seal extending between the multi-car vehicle and the tubular pathway.

3. A pneumatic transportation system according to claim 1, said plurality of guide wheels maintaining a determined space between the tubular pathway and the multi-car vehicle.

4. A pneumatic transportation system according to claim 1, wherein each of said plurality of pneumatic impellers comprises a plurality of variable pitch blades.

5. A variable-speed pneumatic transportation system according to claim 1, further comprising a plurality of pressure release valves in said tubular pathway.

6. A pneumatic transportation system according to claim 1, further comprising:

a digital controller operably coupled to each of the plurality of turbines, wherein a rotation speed of each of the plurality of turbines is controlled by the digital controller; and each of said plurality of pneumatic impellers comprises a plurality of variable pitch blades, and the digital controller is operably coupled to each of said plurality of variable pitch blades, and each of said plurality of variable pitch blades is controlled by said digital controller; and a plurality of controllable pressure release valves in said tubular pathway, and the digital controller is operably coupled to each of said plurality of controllable pressure release valves, and each of said plurality of controllable pressure release valves is controlled by said digital controller.

* * * * *